US008545091B1

(12) United States Patent
Arribau

(10) Patent No.: US 8,545,091 B1
(45) Date of Patent: Oct. 1, 2013

(54) BLENDER APPARATUS AND METHOD

(71) Applicant: Jorge O. Arribau, Englewood, CO (US)

(72) Inventor: Jorge O. Arribau, Englewood, CO (US)

( * ) Notice: Subject to any disclaimer, the term of this patent is extended or adjusted under 35 U.S.C. 154(b) by 0 days.

(21) Appl. No.: 13/621,395

(22) Filed: Sep. 17, 2012

(51) Int. Cl.
*B01F 3/12* (2006.01)
*B01F 15/02* (2006.01)

(52) U.S. Cl.
USPC ..... 366/3; 366/167.2; 366/169.1; 366/177.1

(58) Field of Classification Search
CPC ..... B01F 13/0035; B01F 3/1221; B01F 5/16
USPC ..... 366/263, 164.4, 165.3, 164.6, 177.1, 366/167.2, 164.1, 164.2, 169.1, 2, 3
See application file for complete search history.

(56) References Cited

U.S. PATENT DOCUMENTS

| | | | | |
|---|---|---|---|---|
| 715,441 | A | | 12/1902 | Vandergrift |
| 727,032 | A | | 5/1903 | Tubbs |
| 865,128 | A | | 9/1907 | Smith |
| 1,062,803 | A | | 5/1913 | Simond |
| 2,226,470 | A | | 12/1940 | McGuffee |
| 2,272,573 | A | | 2/1942 | Messmore |
| 2,569,439 | A | | 10/1951 | Blake |
| 3,256,181 | A | | 6/1966 | Zingg et al. |
| 3,326,536 | A | | 6/1967 | Zingg at al. |
| 3,339,897 | A | | 9/1967 | Davis et al. |
| 3,371,614 | A | | 3/1968 | Crisafulli |
| 3,953,150 | A | | 4/1976 | Onal |
| 3,998,433 | A | * | 12/1976 | Iwako ..... 366/178.3 |
| 4,239,396 | A | | 12/1980 | Arribau et al. |
| D258,589 | S | * | 3/1981 | Sugiura ..... D15/7 |
| 4,453,829 | A | | 6/1984 | Althouse, III |
| 4,460,276 | A | | 7/1984 | Arribau et al. |
| 4,614,435 | A | | 9/1986 | McIntire |
| 4,628,391 | A | | 12/1986 | Nyman et al. |
| 4,808,004 | A | * | 2/1989 | McIntire et al. ..... 366/155.1 |
| 4,834,542 | A | | 5/1989 | Sherwood |
| 4,850,702 | A | | 7/1989 | Arribau et al. |
| 4,893,941 | A | | 1/1990 | Wayte |
| 5,460,444 | A | | 10/1995 | Howorka |
| 5,904,419 | A | | 5/1999 | Arribau |
| 6,428,711 | B1 | | 8/2002 | Nakamura et al. |
| 6,877,954 | B2 | | 4/2005 | Lin et al. |
| 6,974,246 | B2 | | 12/2005 | Arribau et al. |
| 7,334,937 | B2 | | 2/2008 | Arribau et al. |
| 7,967,500 | B2 | * | 6/2011 | Arribau et al. ..... 366/164.6 |
| 2004/0218464 | A1 | | 11/2004 | Arribau et al. |
| 2004/0218465 | A1 | | 11/2004 | Arribau et al. |

* cited by examiner

*Primary Examiner* — Tony G Soohoo
(74) *Attorney, Agent, or Firm* — Reilly Intellectual Property Law Firm, P.C.

(57) ABSTRACT

A method and apparatus for blending liquids and granular materials in which an impeller assembly is mounted for rotation within a housing at a lower end of a particles inlet and characterized in particular by circumferentially spaced impeller vanes in outer concentric relation to a series of expeller vanes surrounding the particles inlet and which together propel the solid particles outwardly to intermix with the liquid introduced into the annulus surrounding the impeller assembly, and different selected vane configurations are provided with circumferential portions protruding into the path of counterflow of the slurry from the annulus in order to keep the eye or central area of the impeller assembly dry.

19 Claims, 6 Drawing Sheets

BLENDER APPARATUS AND METHOD

BACKGROUND AND FIELD OF INVENTION

The following relates to a novel and improved method and apparatus for controlling the introduction of solids into a chamber containing a pressurized fluid, such as, for example, blenders for intermixing and pumping large volumes of liquid/sand slurries in downhole fracking operations.

Previously I have devised different blade or vane designs for a given ratio of impeller diameters. In the past, the vanes were designed to balance the point at which the solids and liquids were intermixed between the outer space surrounding the impeller vanes and the center of the impeller assembly in order to allow the introduction of dry sand through the center of the impeller. Among other considerations in determining the design of the impeller vanes is the mass flow rate or capacity of flow of the solid particles as well as their density for a given speed of rotation of the impeller vanes; and to multiply the RPMs or speed by the number of vanes which in turn will aid in establishing the spacing between the vanes as well as their depth.

Still another variable to be taken into consideration is the rate at which the sand is ejected from the center to the impeller region and which may be influenced both by the utilization of expeller blades and a generally conical or raised center. Further, once the diameter of the expeller and its number of vanes is established based on the desired flow rate of sand particles, the diameter of the impeller and shape of its vanes can be determined in order to achieve optimum rate of flow of the sand particles through the impeller region. Conversely, it is important to compute the rate of counterflow of liquids through the spaces between the impeller vanes toward the center of the impeller assembly. From that, one is able to determine the optimum balance point or size and position of vanes necessary to reverse the inward flow and force the slurry to return to the outer annular space surrounding the impeller assembly.

In accordance with my U.S. Pat. No. 7,967,500, there is disclosed an arrangement or configuration of vanes in which the liquid would follow a path between the primary vanes toward the center of the impeller, until it reached the next vane which would cause it to reverse and flow away from the center. Nevertheless, there is a need for utilizing blocking vanes in the spaces between the primary vanes in order to keep the eye of the impeller dry and to regulate the balance point between the solids and slurry in a region radially outwardly of the eye while pumping the slurry over a wide range of mass flow rates. Further, there is a continuing need for impeller vane designs which not only achieve the foregoing but minimize the energy expended and reduce wear over long-term use while further simplifying the construction and minimizing the number of parts required in preventing liquid or slurry leakage back into the eye or central area of the assembly.

SUMMARY

Is therefore an object to provide for a novel and improved method and apparatus for blending liquid and solid particles with a simplified impeller assembly which minimizes wear, expenditure of energy and replacement of parts while maintaining optimum blending conditions and preventing the counterflow of liquid or slurry back into the eye of the impeller.

Another object is to provide for a method of designing an impeller which takes into consideration a number of variables including flow rates, density and size of particles for a given number and speed of rotation of the impeller vanes as well as their spacing.

Another object is to provide for an impeller assembly having blocking vane surfaces incorporated into the primary vanes and so spaced and arranged as to maintain optimum balance and deflection of slurry away from the eye of the impeller.

It is another object to minimize energy consumption resulting from the counterflow of the liquid between the vanes by blocking the counterflow as close to its origin as possible and causing it to be redirected back into the annular space surrounding the impeller assembly.

In one aspect, an impeller assembly is characterized in particular by having generally three-sided vanes extending upwardly from a base plate which is in surrounding relation to an eye of the impeller and which in turn is surrounded by an annular housing, each vane having opposite sides converging outwardly from an end surface at or adjacent to an inner radial edge of the base plate and terminating in an apex at or near an outer circumferential edge of the base plate.

In another aspect, an apparatus has been devised for fracking operations which will maintain the delivery of sand through an upper particles inlet in a fluidic state by the selective removal of air from the sand as it approaches the impeller region as well as spreading the sand away from the eye of the impeller to maintain uniform delivery while minimizing blockage and to maintain uniform high speed mass rates of flow of the sand as it intermixes with the water in the formation of a slurry to be used for downhole fracking operations.

In still another aspect, a novel and improved expeller is interposed between the inlet and the impeller assembly to accelerate the delivery of sand from the inlet for intermixture with the water in the impeller region. The inner circumferential end surfaces of the impeller vanes are aligned with the expeller vanes extending radially outwardly from the solid inlet. The impeller vanes are increased in thickness towards their outer radial ends and are much closer to the leading end of the next vane in blocking return flow of the slurry formed between the water flowing under pressure into the impeller assembly from the annular housing and solid particles driven outwardly by the expeller vanes.

In another aspect, the impeller vanes may contain blocking ledges toward their inner ends which are closer to and in facing relation to the outer radial ends of each adjacent vane to redirect and prevent the counterflow of slurry toward the center of the impeller.

Further aspects and embodiments will become apparent by reference to the following drawings when taken together with the detailed description and it is intended that the embodiments disclosed herein are to be considered illustrative rather than limiting.

DETAILED DESCRIPTION OF FIRST EMBODIMENT

Figure 1:
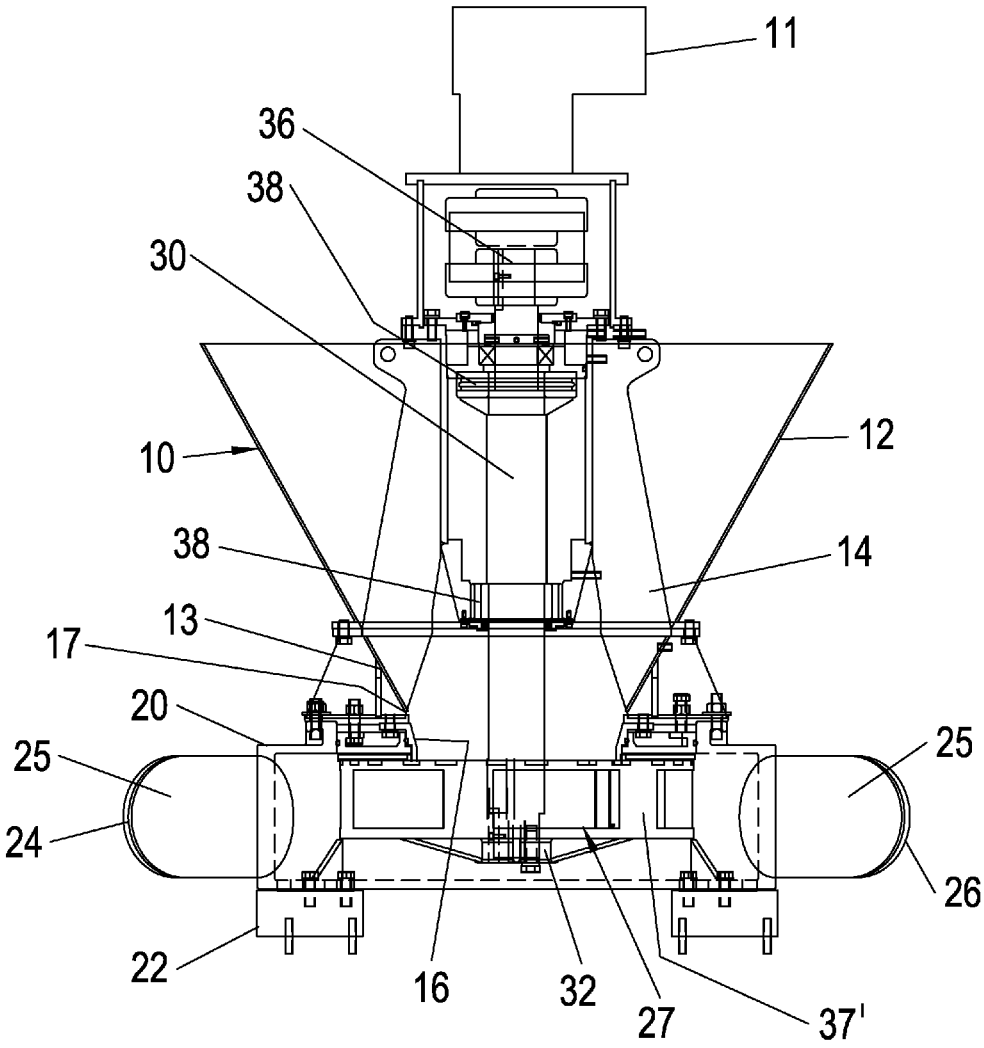
FIG. 1 is an elevational view, partially in section of a hydraulically driven mixing system with a low profile blender assembly.
Figure 2:
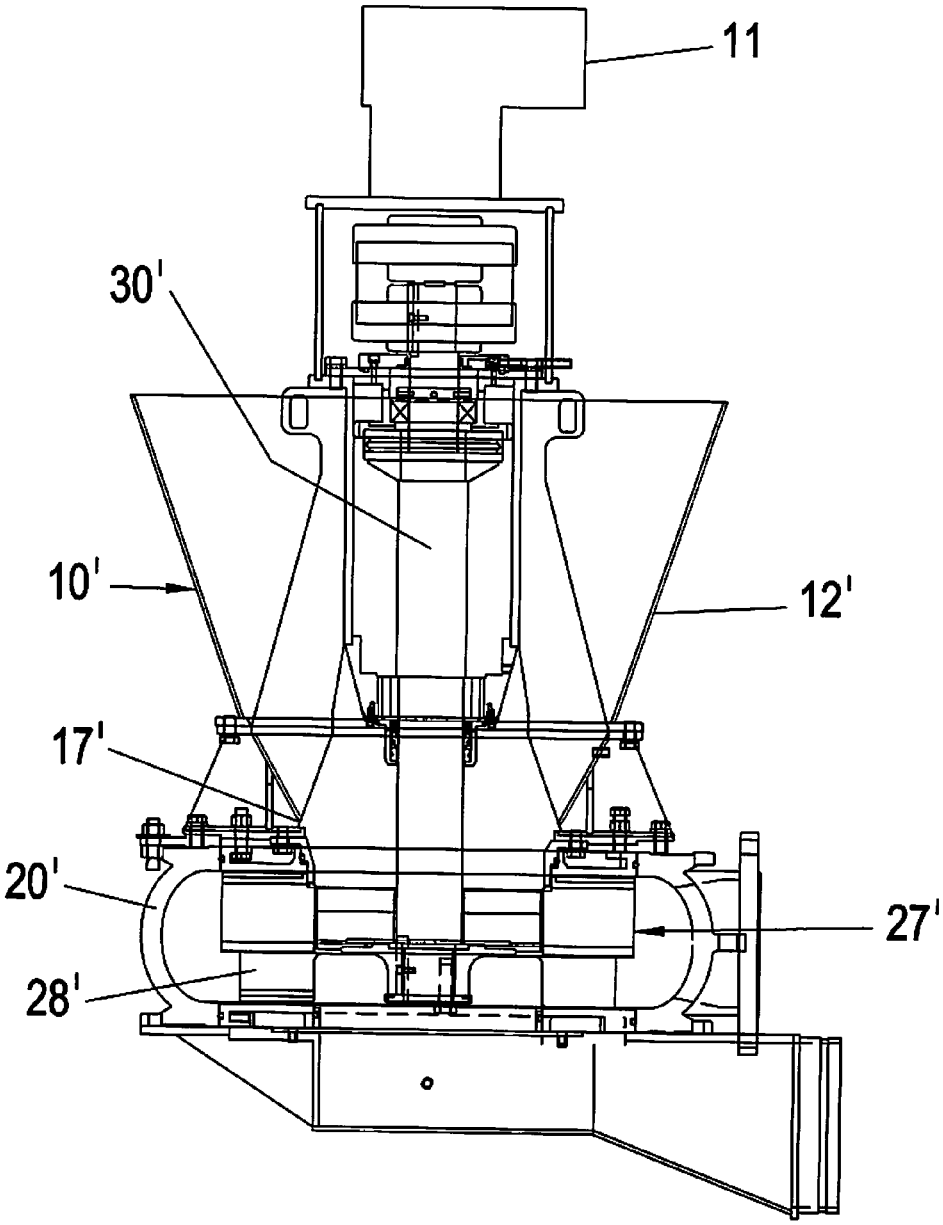
FIG. 2 is another elevational view, partially in section of a hydraulically driven mixing pump.

Referring in detail to the drawings, apparatus 10 takes the form of a hydraulically driven mixer shown in FIG. 1 and which may be mounted on a truck, not shown, but shown and described in detail in my U.S. Pat. No. 7,967,500. As illustrated in FIGS. 1 and 2 of that patent, a booster pump communicates with an intake port, such as, intake port 24 illustrated in FIG. 1 herein. As shown in more detail in FIGS. 1 and 2 of my hereinbefore referred to patent, in oil and gas operations, such as, fracturing or cementing wells, the pump 10 is mounted on a truck bed along with an engine with a drive mechanism to impart rotation via a speed reducer mechanism to a central drive shaft. The solid granular matter, such as, sand is delivered from a storage area by means of an auger to the upper end of a hopper and advanced by gravity into the impeller area. The sand is mixed with a liquid which is introduced through the port 24, and the resultant slurry is discharged via an outlet port 26 through a delivery tube under sufficient pressure to be delivered to a well head. The booster pump regulates the pressure in the annulus of the impeller assembly housing and can be closely controlled to maintain a constant pressure level from the outlet of the pump to the inlet port 24 as well as to increase the pressure as desired.

As a setting for the first embodiment, there is illustrated in FIG. 1 an apparatus 10 having a generally funnel-shaped hopper 12 converging downwardly and terminating in a lower end 13 mounted by circumferentially spaced struts 14 in closely spaced relation to and above the inner wall 16 of a suspension mount for an impeller assembly 27 in the housing 20. The housing 20 is supported on a base mount 22 and includes the intake port 24 and outlet port 26 which are in open communication with an annulus in the housing 20 surrounding impeller assembly 27.

A drive shaft 30 is mounted centrally of the hopper 10 with the lower end journaled in a hub 32 at the center of the base plate 34 of the impeller assembly 27, and its upper end 36 is mounted in bearings 38 beneath a drive motor 11. In the first embodiment, the sand and other dry chemicals mixed with the sand are advanced by gravity into the central blender area and driven outwardly in a manner to be described to form a slurry with liquids, mainly comprising water, which are introduced through the intake port 24 and into the annulus surrounding the impeller assembly 27.

Figure 4:
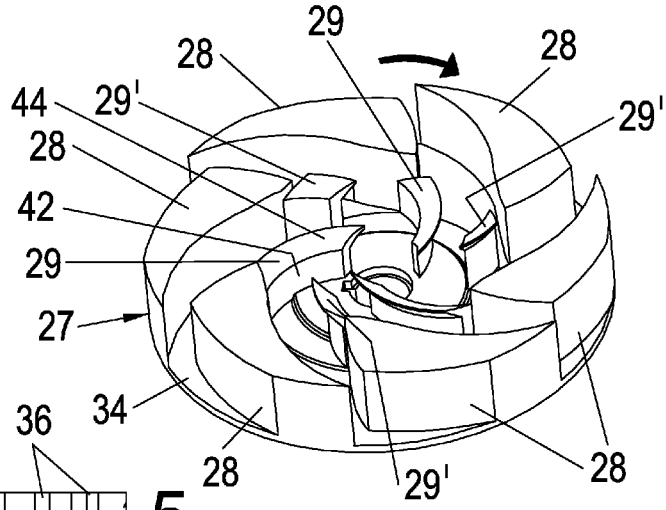
FIG. 4 is a perspective view of a first embodiment of a blender with a combined impeller/expeller assembly.
Figure 7:
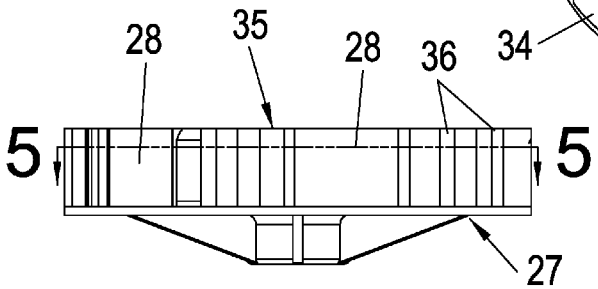
FIG. 7 is an elevational view of the impeller/expeller assembly shown in FIGS. 4 to 6.
Figure 5:
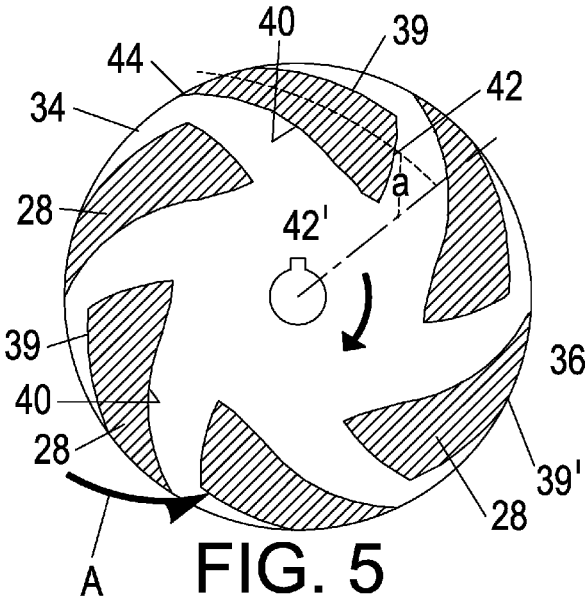
FIG. 5 is a cross-sectional view of the impeller assembly of FIG. 4 taken about lines 5-5 of FIG. 7.
Figure 6:
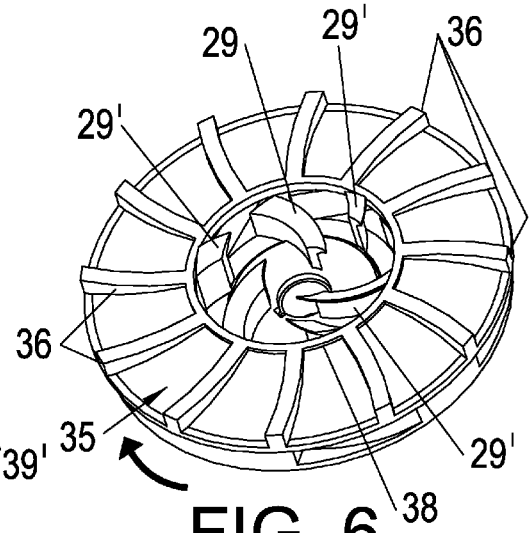
FIG. 6 is a perspective view of a top cover plate over a blender assembly as illustrated in FIG. 4.

FIGS. 4-6 illustrate in more detail the first embodiment of a blender unit 27 which is comprised of the base plate 34 and which supports outer, upwardly extending impeller vanes 28' and inner concentric expeller vanes 29, 29' mounted on the base plate 34 and in surrounding relation to the lower open end of the hopper 12. As shown in FIG. 6, a cover plate 35 is provided with a plurality of circumferentially spaced ribs 36 extending radially along the upper surface of the cover plate 35 from an inner circular rib 38. Each of the ribs 36 is of uniform thickness toward the outer circular edge of the cover plate 35 and cooperates in preventing the radially inward flow of slurry toward the central areas of the blender surrounding the shaft 30. In the alternative, the cover plate 35 and cage 36 may be of the type shown in FIGS. 8 and 10 hereinafter described.

The impeller vanes 28 are circumferentially spaced, arcuate generally 3-sided vanes extending upwardly from the base plate 34 between the outer edges of the expeller vanes 29 and outer circular edge of the base plate 34. Each of the impeller vanes 28 has opposite sides 39 and 40 converging outwardly from an end surface 42 to terminate at an apex 44 at or near an outer circumferential edge of the base plate 34. In turn, the end surface 42 extends substantially in a radial direction from an inner radial edge 42'. One of the sides 39 is of generally convex configuration and the opposite side 40 is of generally concave configuration and taper or converge outwardly toward one another with the convex surface 39 terminating in a curved surface portion 39' which substantially conforms to the curvature of the outer peripheral edge of the base plate 34. In this way, the wider end of each vane 28 toward the center is closest to the leading end of the next adjacent vane 28 and tends to restrict the inward radial counterflow designated at arrow A of the slurry and deflect it back into the annular space between the impeller vanes 28 and outer housing wall 20.

In addition, FIGS. 4 and 6 illustrate in more detail the expeller vane assembly in which a series of expeller vanes are made up of a combination of alternating longer, curved radial vanes 29 extending from the shaft 30 and substantially shorter but taller vanes 29' extending radially inwardly from the outer edge of the base plate 34. Each vane 29, 29' undergoes an arcuate curvature from the central area in a radially outward direction so that its convex side is the leading surface as the vanes undergo rotation in a clockwise direction. Further, each vane 29, 29' has its outer edge aligned with one of the inner radial edges of the impeller vanes 28 so that the solid particles are directed uniformally in an outward radial direction between the impeller vanes 28. The expeller vanes 39 and 40 have similar configurations, each having an upright generally rectangular end surface 42 and an upper right-angled blade portion 44 in order to channel the outward passage of the solid particles into the spaces between the impeller vanes 39, and their slight curvatures will enable smooth transition of the solid particles in an outward radial direction. Also, the upper blade portions 44 are of increasing width toward their outer peripheries and disposed at right angles to the end surfaces 42. In operation, the shorter vanes 29' will contact the sand along the outer region of the expeller and tend to drive the sand sideways and outwardly without contacting the longer vanes; and the longer vanes 29 will contact sand along the inner region of the expeller and force the sand in a circumferential and radially outward direction with little or no contact with the shorter vanes. Again, the shorter vanes 29' are of greater height than the longer vanes 29 and cover substantially the same area as the longer but lower profile vanes and in this way equalize the amount of sand engaged by each set of vanes 29 and 29' respectively, in order to avoid imbalance.

The first embodiment herein described lends itself particularly well to use in low profile impeller assemblies of the type illustrated in FIG. 1 and known in the trade as an open inlet blender of the type shown and described in my U.S. Pat. Nos. 4,239,396 and 4,460,276 in which the impeller assembly is capable of developing an angular velocity which will prevent reverse flow of intermixed materials through the impeller into the solids inlet. In units of this type, it is essential that not only are balanced pressure conditions maintained throughout the system while achieving continuous high volume mixing of the materials, but to avoid pressure build-up of air in the solids inlet and blockage of the sand and other granular material. This is achieved in part by utilization of an expeller arrangement in surrounding relation to an enlarged center shaft and by permitting the escape of air at a point directly adjacent to the solids inlet. In FIG. 1, for example, air is permitted to escape at the juncture of the lower end of the funnel by air relief passages or vents 17 between the wall 16 and lower edge of the funnel 12 and which is in communication with the circular opening leading into the central impeller area above the housing 20 surrounding the impeller assembly 28.

Figure 3:
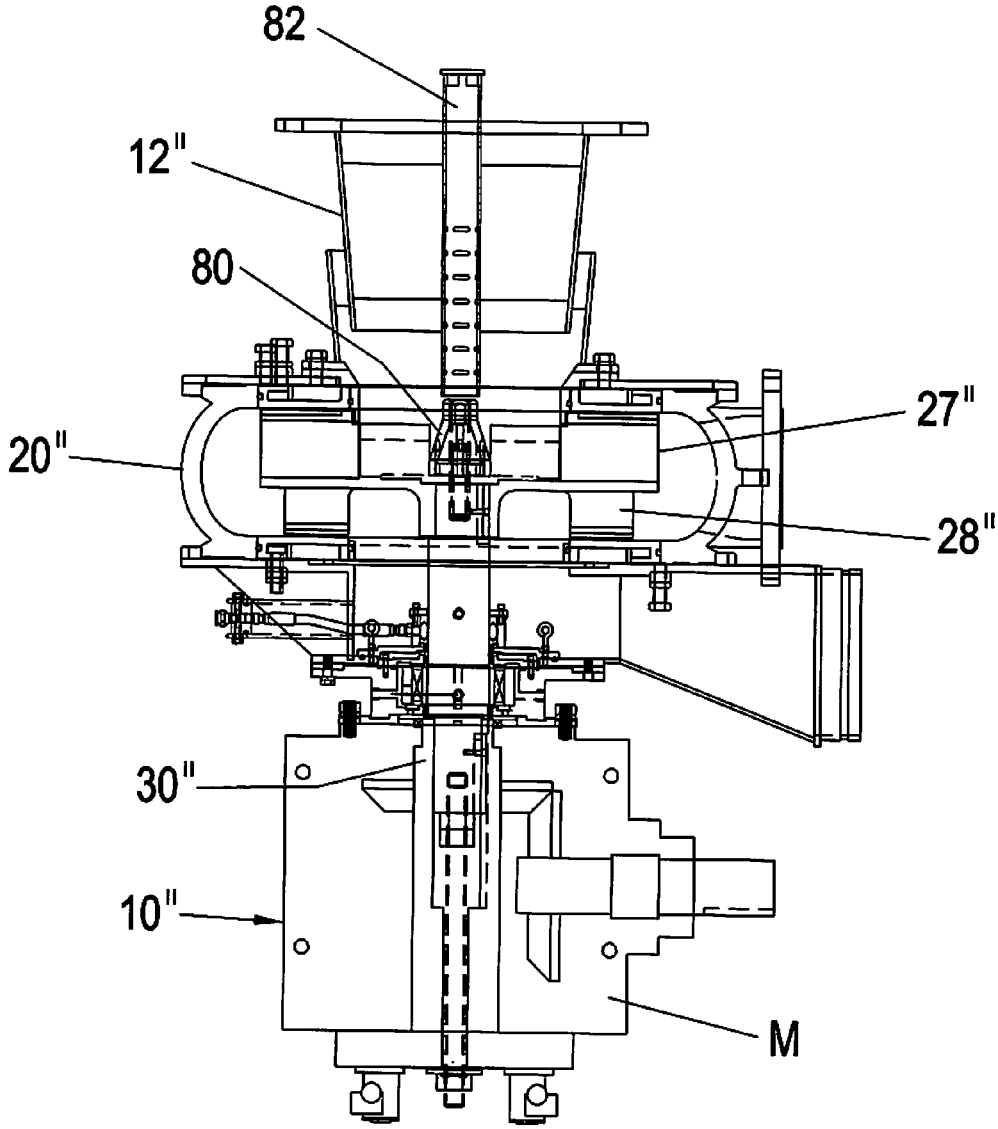
FIG. 3 is an elevational view, partially in section of another form of mechanically driven mixing pump.

FIGS. 2 and 3 illustrate other applications of the blender of FIGS. 4 to 6 to mixing pumps, FIG. 2 being a hydraulically driven mixing pump 10' with a hydraulic motor designated at 11 at the upper end of a drive shaft 30' and once again provided with relief vents or openings 17' between the funnel 12' and upper end of the central opening leading into the central impeller area within the housing 20'. In FIG. 2 the blender or impeller assembly 27' is modified by the addition of lower impeller blades 28' to deliver water under pressure into the annulus or housing 20' surrounding the impeller assembly 27'.

A similar application of the impeller assembly 27 of FIGS. 4 to 6 is illustrated in FIG. 3 of a mechanically driven mixing pump 10" in which gearing M is located beneath the blender for a drive shaft 30" extending upwardly into the blender assembly 27" with lower impeller blades 28" and affixed by a lower conical end nut 80. A perforated tube 82 extends upwardly through a funnel-shaped solids inlet 12". The solids inlet 12" is of two piece construction to permit the escape of air from the solids materials and through spaced openings in the perforated tube 82 to prevent packing and jamming of the sand and pressure build-up of air at the inlet area.

DETAILED DESCRIPTION OF SECOND EMBODIMENT

Figure 10:
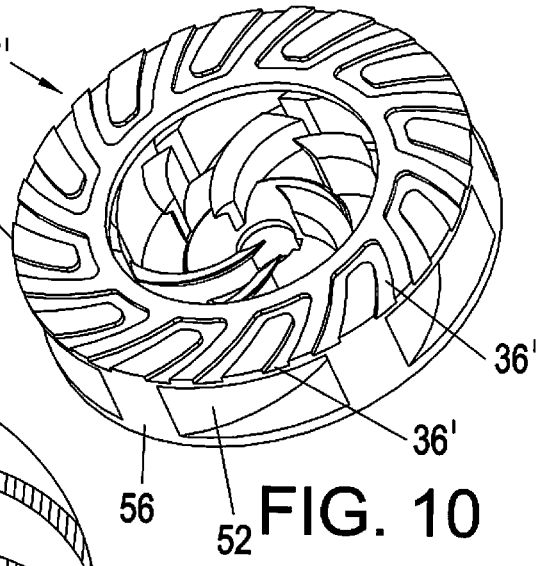
FIG. 10 is a perspective view of a cover plate over a blender assembly illustrated in FIGS. 8 and 9.
Figure 9:
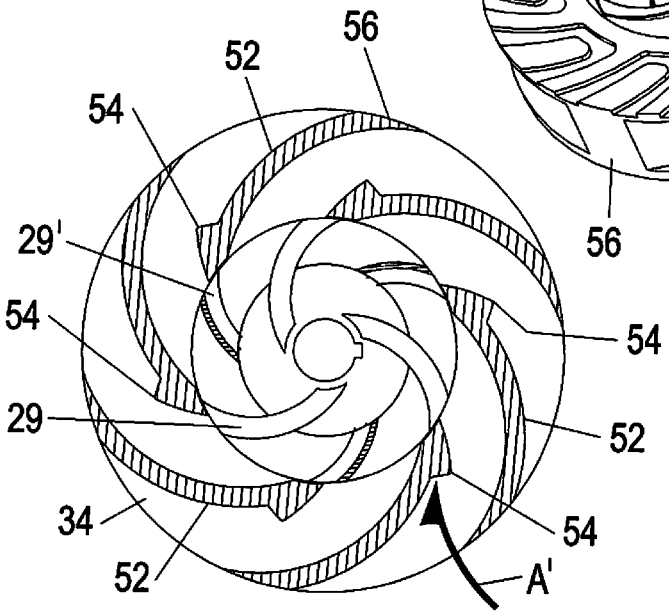
FIG. 9 is a cross-sectional view taken about lines 9-9 of FIG. 7.
Figure 8:
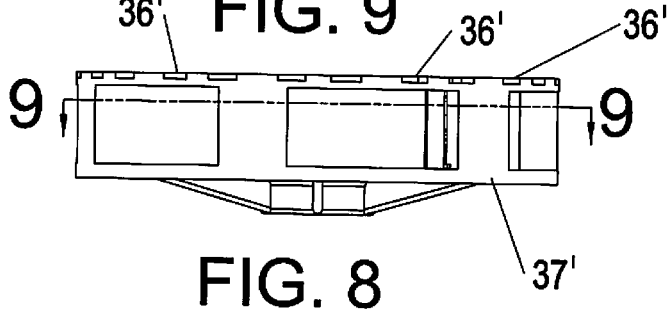
FIG. 8 is an elevational view of a second embodiment of impeller/expeller assembly.

There is illustrated in FIGS. 8-10 a second embodiment in which like or similar parts to those of FIGS. 4-6 are correspondingly enumerated. Thus, the expeller vanes 29, 29' correspond to those of FIGS. 4-6 and are mounted within a modified impeller assembly 27' in which a series of impeller vanes 52 are arranged in equally spaced circumferential relation to one another in the same manner as the vanes 28 in FIGS. 4-6. However, each of the impeller vanes 52 is curved along its entire length from its inner radial edge 54, which is in abutting relation to one of the expeller vanes 29, 29', to its outer radial edge 56 at the outer circumferential edge of the base plate 34. Each vane 52 is of uniform width or thickness along its length and of a height corresponding to the height of the shorter expeller vanes 29'; however at its inner radial end, each vane 52 includes a V-shaped lateral extension or deflector 54 which juts into the path of counterflow designated by arrow A' of any slurry attempting to return to the center or eye of the blender 2. FIGS. 8 to 10 illustrate a modified form of cover plate 35' having a raised surface 36' with U-shaped grooves 36' at uniformly spaced intervals around the cover plate with the open ends of the grooves extending radially outwardly. The cover plate is mounted against the undersurface of the top wall of the housing 20 and spaced above the impeller assembly 27'. The assembly 27' is a unitary part of and extends downwardly from the cover plate 35'.

DETAILED DESCRIPTION OF THIRD EMBODIMENT

Figure 12:
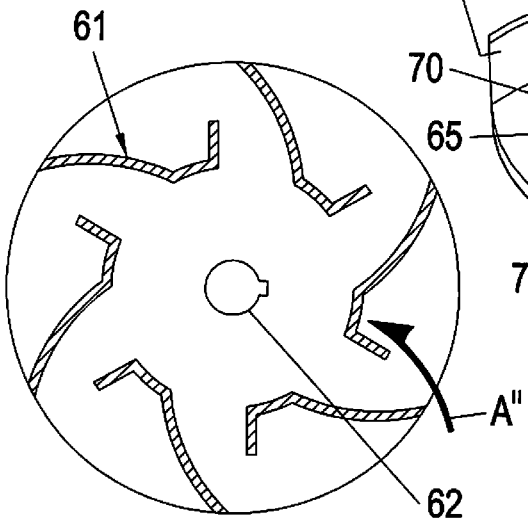
FIG. 12 is a perspective view of another form of a blender with the impeller assembly of FIG. 11.
Figure 13:
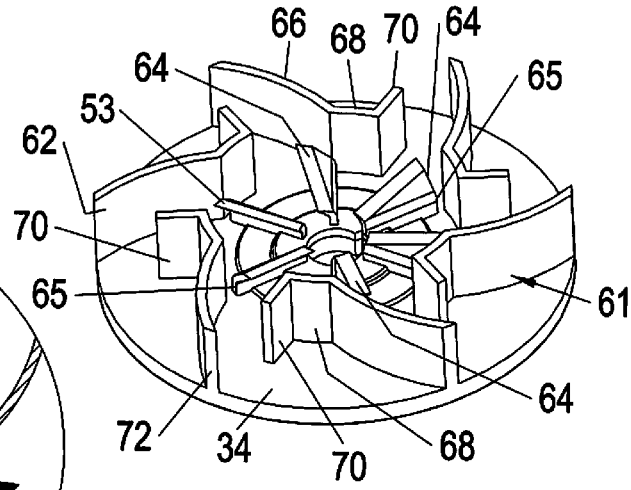
FIG. 13 is a plan view of FIG. 11.
Figure 11:
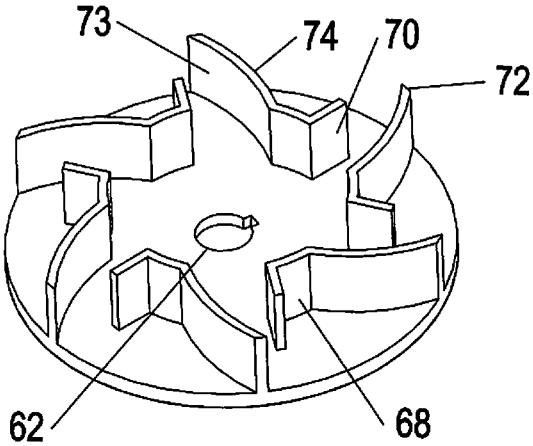
FIG. 11 is a perspective of a third embodiment of impeller assembly.

Another embodiment is illustrated in FIGS. 11 to 13 and in which a modified form of impeller assembly is illustrated in place of the impeller assembly 27 in the embodiment shown in FIGS. 4-6. Once again, a circular base plate 34 has a central opening 62 which is mounted for rotation on a central drive shaft as in the other embodiments. A central expeller vane assembly is made up of generally triangular blades 64 of uniform thickness and diverging upwardly and outwardly from the center 62 to an outer vertical edge 65 in closely spaced facing relation to an inner surface of each of the impeller vanes 61 to be hereinafter described. Upper inclined edge 63 of each expeller blade 64 is curved laterally in the direction of rotation of the vanes 61. In turn, each of the impeller vanes 61 has an arcuate blade 66 curving radially and outwardly from an elbow-shaped portion made up of an inner radial end 68 and a short, radially extending return portion 70. The blade elements 66, 68 and 70 are of uniform thickness and the major blade element 66 curves in an outward radial direction from its inner radial edge to an outer radial edge 72 which is flush with the outer circular edge of base plate 34. Accordingly, one side surface 73 is concave and the opposite side 74 is convex, and each return portion 70 extends radially outwardly in a direction toward an outer edge 72 of each next blade 62 in succession so as to define a limited space or gap between the adjacent vanes. In a manner to be described, the spacing between adjacent vanes is regulated to limit the counterflow of slurry toward the center of the impeller/expeller assembly.

Although not shown, it will be evident that either one of the cover plates and the expeller assemblies of the three embodiments are interchangeable. For the purpose of illustration but not limitation, the assembly 27" of FIGS. 11 to 13 are shown as part of the blender assembly in FIG. 3 but the base plate 34 serves as a divider plate for a lower impeller assembly designated at 28". In a similar manner, the first and second embodiments are interchangeable and may be mounted as illustrated in FIGS. 1 and 2 with or without a lower impeller arrangement.

In the design of the impeller vanes, a number of factors must be taken into consideration as noted earlier and including but not limited to the velocity of the liquid toward the center of the impeller after each vane passes by a given point on the impeller. Referring to FIG. 5, for example, the arrow A represents the direction of return flow of slurry entering the space between vanes 28. In this respect, the widened end of each impeller vane will act as a deflector and can be moved outwardly to meet the fluid path as close to its origin as possible to the outer periphery of the impeller assembly. In other words, the sooner the fluid is blocked and redirected back toward the annulus the less energy will be consumed.

FIG. 9 represents an alternative approach by the utilization of the ledges or blocking vanes 54 opposite to the point of entry of the liquid from the annulus into the space between the vanes 52. This approach reduces the overall size of each vane but does require greater energy in that the deflector is located closer to the center of the impeller assembly before it is deflected back toward the annulus. Here the liquid or fluid path is represented by the arrow A'.

FIG. 13 illustrates still another approach in which the blocking vane is mounted more toward the bottom of the vane with its return end 70 being positioned in the path of slurry to prevent it from invading the center of the impeller, but requires greater energy consumption by virtue of the greater spacing between the outer end or edge 72 of each impeller and the inner end 68 of each next successive impeller. Thus, the fluid path is represented by the arrow A" which is much longer and, while the fluid is blocked from reaching the center of the impeller, must be pumped back into the annulus thereby reducing the efficiency of the system. In this regard, the amount of pressure generated by the mixing pump in relation to the mass rate of flow of the sand or other granular material must be taken into consideration in determining the most efficient impeller assembly to utilize.

It is therefore to be understood that while preferred methods and apparatus have been herein set forth and described, various modifications and changes may be made to the construction and arrangement of parts, and their interchangeability without departing from the spirit and scope of the embodiments described herein and as defined by the appended claims.

I claim:

1. In blender apparatus for blending liquids and solid particles wherein a housing has an upper solid particles inlet and a lower liquid inlet, a motive power source including a drive shaft extending into said solid particles inlet, and an outlet communicating with an annular space in said housing above said lower liquid inlet for directing slurry resulting from the intermixture of the solid particles driven outwardly by an impeller with liquids flowing into the annular space in said housing, the improvement comprising:

an impeller assembly having a base plate in surrounding relation to a lower end of said particles inlet and circumferentially spaced, radially extending vanes mounted on said base plate, each of said vanes having opposite leading and trailing sides extending outwardly from an end surface adjacent to an inner radial edge of said base plate and terminating at an apex adjacent to an outer circumferential edge of said base plate; and wherein each of said leading sides of said vanes includes a circumferentially projecting portion adjacent to said end surface in the path of travel of said slurry into spaces between adjacent of said vanes to deflect said slurry in a radially outward direction into said annular space.

2. In apparatus according to claim 1 wherein a plurality of expeller vanes are interposed between said drive shaft and said vanes of said impeller assembly.

3. In apparatus according to claim 2 wherein said solid particles inlet includes air relief vents.

4. In apparatus according to claim 3 wherein said solid particles inlet is of generally funnel-shaped configuration in surrounding relation to said drive shaft and includes at least one of said vents.

5. In apparatus according to claim 2 wherein said expeller vanes are aligned with said impeller vanes, said circumferentially projecting portions each including a radially outwardly facing ledge in the path of travel of said slurry into said spaces between adjacent of said vanes.

6. In apparatus according to claim 5 wherein each of said expeller vanes has upper ends extending laterally in a direction away from the direction of rotation of said impeller vanes.

7. In apparatus according to claim 1 said spaces are reduced toward said outer circumferential edge.

8. In blender apparatus for blending liquids and solid particles wherein a housing has an upper solid particles inlet and a lower liquid inlet, a motive power source including a drive shaft extending into said solid particles inlet, and an outlet communicating with an annular space in said housing above said lower liquid inlet for directing slurry resulting from the intermixture of the solid particles driven outwardly by said impeller with liquids flowing into the annular space in said housing, the improvement comprising:

an impeller assembly having a base plate in surrounding relation to a lower end of said particles inlet and circumferentially spaced, three-sided vanes mounted in equally spaced relation to one another on said base plate, each of said vanes having opposite leading and trailing sides extending outwardly from an end surface adjacent to an inner radial edge of said base plate and terminating at an apex adjacent to an outer peripheral edge of said base plate; and wherein each of said leading sides of said vanes includes a circumferentially projecting portion adjacent to said end surface in the path of travel of said slurry into spaces between adjacent of said vanes to deflect said slurry in a radially outward direction into said annular space.

9. In apparatus according to claim 8 wherein one of said opposite leading and trailing sides of said vanes is of concave configuration and the other of said opposite leading and trailing sides is of convex configuration, and each of said convex sides terminating in an outer end extending substantially parallel to said outer peripheral edge of said base plate.

10. In apparatus according to claim 9 wherein said opposite leading and trailing sides of each said vane terminate in a common apex adjacent to said outer peripheral edge of said base plate.

11. In apparatus according to claim 8 wherein each of said vanes is bisected by an imaginary line extending at an acute angle to an imaginary radial line extending from a longitudinal axis of said drive shaft.

12. Apparatus for blending liquids and solid particles comprising in combination:

a housing having an upper particles inlet and a lower liquid inlet, a central drive shaft, and an outlet in an outer wall of said housing;

an impeller assembly mounted for rotation at a lower end of said upper particles inlet including a base plate and a plurality of circumferentially spaced impeller vanes extending upwardly from said base plate;

an expeller assembly mounted for rotation between said drive shaft and said impeller assembly having a plurality of circumferentially spaced vanes aligned with said impeller vanes; and a plurality of air vents mounted in surrounding relation to a lower end of said upper particles inlet in communication with said particles advancing therethrough.

13. Apparatus according to claim 12 wherein a plurality of expeller vanes are interposed between said drive shaft and said vanes of said impeller assembly.

14. Apparatus according to claim 13 wherein said expeller vanes are aligned with said impeller vanes.

15. Apparatus according to claim 12 wherein a tubular member located centrally of said impeller assembly is provided with a plurality of air relief vents.

16. Apparatus according to claim 12 wherein each of said expeller vanes has an upper rounded end curving in a direction away from the direction of rotation of said expeller vanes.

17. In a blender according to claim 1 for fracking material composed at least in part of sand and water wherein sand is introduced into a generally funnel-shaped inlet and a motor driven impeller assembly is mounted for rotation on a drive shaft at a lower end of said inlet, the method of introducing sand into said inlet and advancing at high rates of speed into said impeller assembly to form a slurry with water delivered under pressure into an annulus surrounding said assembly comprising the steps of:

spreading the sand away from the center of said inlet and advancing into said impeller assembly; and blocking the counterflow of sand and water in a radial inward direction between said impeller vanes before it reaches the area inside of said impeller.

18. In a blender according to claim 17, the method including the step of withdrawing air from the sand in said inlet through air relief vents in said inlet.

19. In a blender according to claim 18, the method including the step of providing said air relief vents at intervals along said inlet.

* * * * *